US010920309B2

(12) United States Patent
Kaup et al.

(10) Patent No.: US 10,920,309 B2
(45) Date of Patent: Feb. 16, 2021

(54) METHOD FOR PRODUCING A NITRIDED PACKAGING STEEL

(71) Applicants: ThyssenKrupp Rasselstein GmbH, Andernach (DE); ThyssenKrupp AG, Essen (DE)

(72) Inventors: Burkhard Kaup, Andernach (DE); Blaise Massicot, Burgbrohl (DE); Dirk Matusch, Neuwied (DE)

(73) Assignees: ThyssenKrupp Rasselstein GmbH, Andernach (DE); ThyssenKrupp AG, Essen (DE)

( * ) Notice: Subject to any disclaimer, the term of this patent is extended or adjusted under 35 U.S.C. 154(b) by 961 days.

(21) Appl. No.: 15/506,911

(22) PCT Filed: Jul. 2, 2015

(86) PCT No.: PCT/EP2015/065055

§ 371 (c)(1),
(2) Date: Feb. 27, 2017

(87) PCT Pub. No.: WO2016/030056

PCT Pub. Date: Mar. 3, 2016

(65) Prior Publication Data

US 2017/0253957 A1 Sep. 7, 2017

(30) Foreign Application Priority Data

Aug. 27, 2014 (DE) ..... 10 2014 112 286.0

(51) Int. Cl.
*C23C 8/26* (2006.01)
*C22C 38/00* (2006.01)
(Continued)

(52) U.S. Cl.
CPC ..... *C23C 8/26* (2013.01); *C21D 8/02* (2013.01); *C21D 8/0205* (2013.01);
(Continued)

(58) Field of Classification Search
None
See application file for complete search history.

(56) References Cited

U.S. PATENT DOCUMENTS 3,139,359 A 6/1964 Morgan
3,208,844 A 9/1965 Kato et al.
(Continued)

FOREIGN PATENT DOCUMENTS

DE 1132168 B 6/1962
DE 1433690 A1 12/1968
(Continued)

OTHER PUBLICATIONS

Johnson, Furnace Atmospheres, ASM Handbook vol. 4 Heat Treating, published 1991, (Year: 1991).*
(Continued)

*Primary Examiner* — Colleen P Dunn
*Assistant Examiner* — Michael J Kachmarik
(74) *Attorney, Agent, or Firm* — Paul D. Bianco; Katharine Davis; Fleit Intellectual Property Law

(57) ABSTRACT

A nitrided packaging steel in the form of a flat steel product and method for producing a nitrided packaging steel with a carbon content of 10-1000 ppm and uncombined nitrogen, dissolved in the steel, of more than 100 ppm. The nitriding is performed in two stages: a first stage, in which a molten steel is nitrided to a nitrogen content of at most 160 ppm by introducing a nitrogen-containing gas and/or a nitrogen-containing solid into the molten steel, and a second stage, in which a flat steel product produced from the nitrided molten steel by cold rolling is treated with a nitrogen-containing gas in order to increase further the amount of uncombined nitrogen in the flat steel product.

20 Claims, 1 Drawing Sheet

(51) Int. Cl.

| | |
|---|---|
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C23C 8/80*** | (2006.01) |
| ***C23F 17/00*** | (2006.01) |
| ***C21D 8/04*** | (2006.01) |

(52) U.S. Cl.

CPC ..... *C21D 8/0236* (2013.01); *C21D 8/0257* (2013.01); *C21D 8/04* (2013.01); *C21D 8/0405* (2013.01); *C21D 8/0436* (2013.01); *C21D 8/0457* (2013.01); *C21D 8/0473* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/42* (2013.01); *C23C 8/80* (2013.01); *C23F 17/00* (2013.01)

(56) References Cited

U.S. PATENT DOCUMENTS

| | | | | |
|---|---|---|---|---|
| 3,219,494 | A | 11/1965 | Hartner et al. | |
| 4,405,390 | A * | 9/1983 | Hoshino | C22C 38/40 420/34 |
| 6,764,528 | B2 * | 7/2004 | Nabeshima | C21C 7/04 148/541 |
| 6,974,511 | B1 | 12/2005 | Bouzekri | |
| 7,169,244 | B1 * | 1/2007 | Bouzekri | C21D 8/0468 148/603 |
| 8,303,730 | B2 | 11/2012 | Kumano et al. | |

FOREIGN PATENT DOCUMENTS

| | | | |
|---|---|---|---|
| DE | 2105391 | A1 | 8/1971 |
| DE | 2237498 | A1 | 2/1974 |
| DE | 69015817 | T2 | 6/1995 |
| DE | 695 13 347 | T2 | 7/2000 |
| DE | 10117118 | C1 | 7/2002 |
| DE | 60000342 | T2 | 5/2004 |
| DE | 102014106135 | A1 | 11/2015 |
| EP | 0216399 | A1 | 4/1987 |
| EP | 764725 | | 3/1997 |
| EP | 1065286 | | 1/2001 |
| EP | 1342798 | A1 | 9/2003 |
| EP | 1709208 | A1 | 10/2006 |
| EP | 2330223 | | 6/2011 |
| JP | H08260059 | | 10/1996 |
| JP | H1121627 | A | 1/1999 |
| JP | H11315343 | A | 11/1999 |
| JP | 5827930 | A | 3/2014 |
| KR | 20130055916 | | 5/2013 |
| WO | 2005/056841 | A | 6/2005 |

OTHER PUBLICATIONS

Winter, Gas Nitriding and Gas Nitrocarburizing of Steels, ASM Handbook, vol. 4A, published 2013, (Year: 2013).*

Lahoti, Flat, Bar, and Shape Rolling, ASM handbook vol. 14A: Metalworking: Bulk Forming, published 2005, (Year: 2005).*

International Preliminary Report on Patentability dated Feb. 28, 2017 for PCT/EP2015/065055 filed Jul. 2, 2015.

Written Opinion dated Jan. 3, 2017 for PCT/EP2015/065055 filed Jul. 2, 2015.

International Search Report dated Sep. 18, 2015 for PCT/EP2015/065055 filed Jul. 2, 2015.

Written Opinion dated Mar. 3, 2016 for PCT/EP2015/065055 filed Jul. 2, 2015.

German Result of Examination Report for DE 10 2014 112 286.0 filed Aug. 27, 2014.

Notice of Opposition dated Mar. 11, 2020 of European Application No. 3186401(8 pages).

Furnace atmospheres "revise per Paul Johnson, published in 1991" ASM Handbook (28 pages).

* cited by examiner

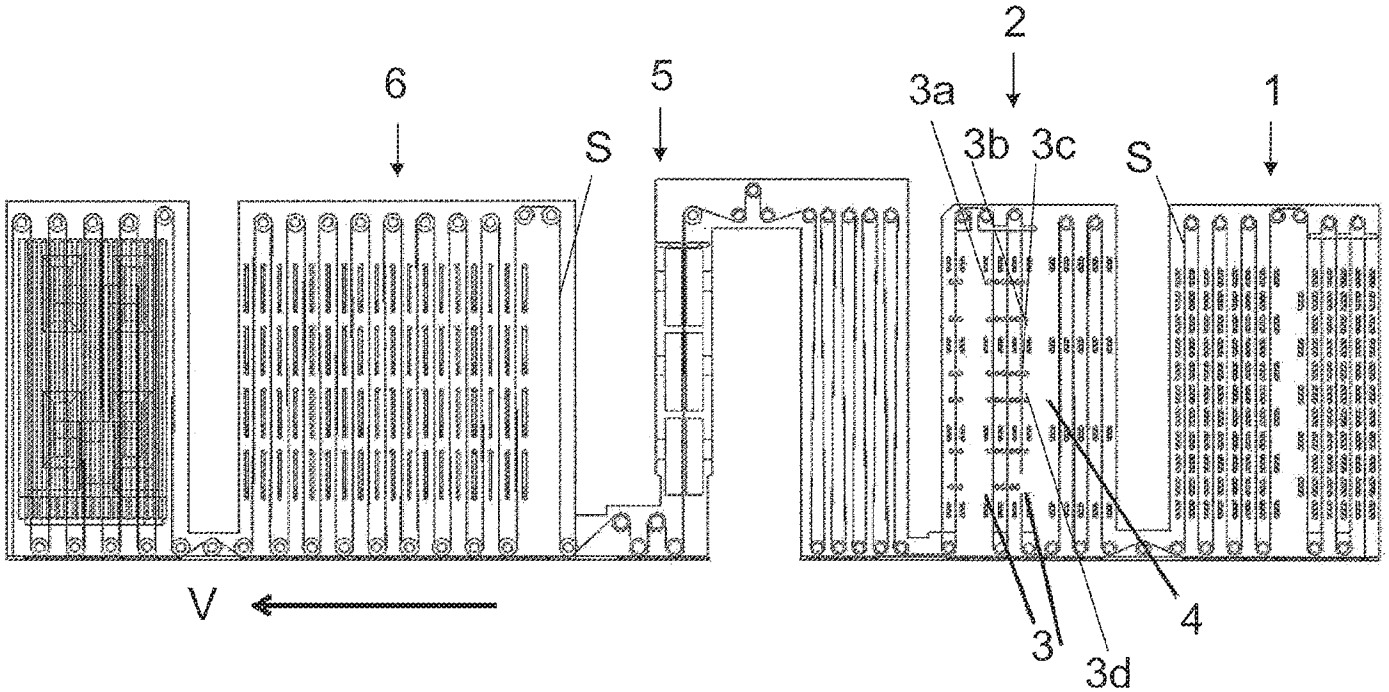
1
2
3a
3b
3c
S
4
3d
3
5
S
6
V

METHOD FOR PRODUCING A NITRIDED PACKAGING STEEL

FIELD OF THE INVENTION

The present invention relates to a method of producing nitrided packaging steel and to a nitrided packaging steel in the form of a flat steel product.

BACKGROUND OF THE INVENTION

It is known from the prior art that the strength of steels can be increased by introducing uncombined nitrogen dissolved in the steel. The introduction of uncombined nitrogen into the steel is called nitriding which is a well-known method used in the hardening of steel and steel products.

It is also known from the prior art that flat steel products, such as steel sheets or steel strips, which are to be used to produce packaging materials (subsequently referred to as packaging steel) can be nitrided. EP 0 216 399 B1, for example, describes a steel sheet for packaging purposes as well as a method of producing such a steel sheet that was produced from an aluminum-killed, continuously cast carbon-manganese steel and which, by means of nitriding, received an amount of uncombined dissolved nitrogen, with the minimum amount of uncombined nitrogen being defined as a function of a desired hardness category of the steel sheet and (for example, for the hardness category T61 of the European Standard 145-78) having an amount of uncombined nitrogen of at least 5 ppm. With respect to the carbon and manganese content, the chemical composition of the steel sheet disclosed in that document is in keeping with the conventional soft steels, for example, having a carbon content in a range of 0.03 to 0.1 wt % and a manganese content from 0.15 to 0.5 wt %. The steel sheet is distinguished by a high upper yield stress in the range of 350 to 550 N/mm$^2$. The maximum amount of uncombined nitrogen dissolved in the steel is said to be 100 ppm, with the reason given for this maximum value being that because of the associated increase in strength, a steel sheet with a higher content of uncombined nitrogen can no longer be cold-rolled, and therefore is no longer suitable for the intended use as a cold-rolled packaging steel.

According to the method of producing this prior-art packaging steel, steel is first continuously cast, subsequently hot-rolled, cold-rolled, subjected to recrystallization annealing and finally skin pass rolled. After skin pass rolling the steel, a thermal post-treatment is carried out, during which free dislocations that are formed in the steel as a result of skin pass rolling are fixed by the uncombined nitrogen introduced by nitriding in order to increase the hardness and the yield stress to values higher than those measured after skin pass rolling. The thermal post-treatment can preferably be combined with another thermal treatment of the skin pass rolled steel which, in the course of the production of packaging steel, must be carried out anyway, e.g., while heat-softening a coating of tin which had been electrolytically applied to the surface of the steel sheet or while baking a coating of lacquer which had been applied to the surface of the steel sheet.

Because of the upper limit of 100 ppm proposed in EP 0 216 399 B1 for the amount of the uncombined nitrogen dissolved in the steel, the strengths of this prior-art packaging steel are limited. Theoretically, it seems possible to produce steel sheets with an even higher content of uncombined nitrogen in the steel in order to achieve ultimate tensile strengths higher than 600 MPa. Thus, for example, EP 1 342 798 B1 and DE 1 433 690 A1 describe nitrided steels with a nitrogen content up to 250 ppm and up to 400 ppm, respectively. However, in practice, it has not been possible to achieve such a high content of uncombined nitrogen in the steel.

During the production process of steel, steel can be nitrided by introducing nitrogen into the molten steel, for example, by blowing in nitrogen gas $N_2$. A method of nitriding molten steels during the production of steel in the basic oxygen steelmaking process has been described, for example, in DE 2 237 498. Flat steel products, in particular steel strips, can be nitrided by means of a surface conditioning treatment, for example, by diffusing nitrogen into the surface of the steel sheet, which can be accomplished, for example, by gas nitriding in an ammonia atmosphere under slight excess pressure, by bath nitriding in nitrogen-containing salt baths or by plasma nitriding. Because of the diffusion of nitrogen, a hard superficial bonding layer is created on the surface of the steel sheet as well as a diffusion zone underneath in which the nitrogen is embedded down to a specific depth in the (ferritic) steel matrix.

SUMMARY OF THE INVENTION

The disclosure relates to a flat steel product (steel sheet or steel strip) for use in the production of packaging materials, which has the highest possible strength and, at the same time, good elongation to fracture and good forming properties. More particularly, the disclosure relates to packaging steel with strengths of at least 600 MPa and an elongation to fracture of at least 5%. For the intended use as packaging steel, the higher-strength packaging steel should preferably also have sufficient formability, for example, in deep drawing or ironing processes, so as to be able to produce, as intended, packaging materials, e.g., food cans or beverage cans, from the flat steel product. The packaging steel in the form of a flat steel product should also preferably have the typical thicknesses in the range of thin and ultra-thin sheets that are generally produced by means of cold rolling.

Accordingly, a method and a nitrided packaging steel in the form of a flat steel product are disclosed Preferred embodiments of the method and of the packaging steel are also disclosed.

The invention provides a nitrided packaging steel in the form of a flat steel product and a method for producing a nitrided packaging steel with a carbon content of 10-1000 ppm and uncombined nitrogen, dissolved in the steel, of more than 100 ppm. The nitriding is performed in two stages: a first stage, in which a molten steel is nitrided to a nitrogen content of at most 160 ppm by introducing a nitrogen-containing gas and/or a nitrogen-containing solid into the molten steel, and a second stage, in which a flat steel product produced from the nitrided molten steel by cold rolling is treated with a nitrogen-containing gas in order to increase further the amount of uncombined nitrogen in the flat steel product. The second stage is performed in an annealing furnace, in which the flat steel product is at the same time annealed in a recrystallizing manner. The packaging steels produced are distinguished by great strength, in excess of 600 MPa, and good elongation to fracture, regularly in excess of 5%, as well as by good forming properties.

By using the method according to the present invention, it is possible to produce a nitrided packaging steel with a carbon content in a range of 10 to 1000 ppm and an amount of uncombined nitrogen dissolved in the steel of more than 100 ppm. and preferably of more than 150 ppm, wherein nitriding the steel is performed in two stages. In the first stage, molten steel is nitrided to a nitrogen content of a maximum of 160 ppm by feeding nitrogen, for example, in the form of a nitrogen-containing gas and/or a nitrogen-containing solid, into the molten steel. Subsequently, a slab is cast from the thus nitrided molten steel and hot-rolled to produce a hot strip. If necessary, the hot strip (after having been cooled to ambient temperature) is subsequently pickled and cold-rolled to produce a flat steel product (steel sheet or steel strip). The cold-rolled flat steel product is subsequently subjected to recrystallization annealing in an annealing furnace. In the annealing furnace, the second stage of nitriding is performed by feeding a nitrogen-containing gas into the annealing furnace and directing it onto the flat steel product in order further to increase the amount of uncombined nitrogen in the steel beyond the amount of nitrogen already fed into the molten steel during the first nitriding stage.

Nitriding the packaging steel in two stages ensures that the hot strip can be cold-rolled to produce a flat steel product, more particularly a steel strip, without any problems while using the cold rolling equipment (rolling mill lines) generally used in the production of packaging steels. This is made possible in that in the first nitriding stage, the content of uncombined nitrogen fed into the molten steel is at most 160 ppm. At such a nitrogen content, the hot strip produced from the nitrided molten steel by hot rolling remains cold-rollable, thus making it possible to cold-roll the hot strip and thereby to produce a thin or ultra-thin sheet having the thicknesses usually required for packaging material. In addition, a higher nitrogen content in the molten steel also leads to undesirable defects in the slab cast from the molten steel. The desired strength of preferably more than 600 MPa of the packaging steel is achieved by cold rolling and by recrystallization annealing of the flat steel product during the second nitriding stage. As a result, flat steel products, more particularly steel strips, with thicknesses in the range of thin and ultra-thin sheets for use as packaging steel can be produced with very high ultimate tensile strengths and, at the same time, with a high elongation to fracture of preferably at least 5%, without any restriction in the forming properties.

According to preferred embodiment examples of the method according to the present invention, the molten steel is nitrided in the first stage by feeding nitrogen gas ($N_2$) and/or calcium cyanamide ($CaCN_2$) and/or manganese nitride (MnN) into the molten steel.

The flat steel product is nitrided in the second stage preferably by feeding ammonia gas ($NH_3$) into an annealing furnace in which the flat steel product is subjected to recrystallization annealing. The ammonia gas is preferably sprayed onto the surface of the flat steel product by means of spray nozzles. The amount of ammonia gas that is introduced into the annealing furnace is preferably set to ensure that an ammonia equilibrium with an ammonia concentration in the range of 0.05 to 1.5% results in the annealing furnace. The ammonia concentration in the annealing furnace is preferably measured by means of an ammonia sensor, and the measured value of the ammonia equilibrium concentration is used to control the amount of ammonia gas fed per unit time into the annealing furnace. In this manner, it can be ensured that a consistent ammonia gas concentration is present in the annealing furnace and thus that the flat steel product is homogeneously nitrided and has a quality that is consistent throughout the time it takes to produce a steel strip and a homogeneous nitrogen concentration throughout the length of the steel strip.

During recrystallization annealing in the annealing furnace in the second nitriding stage, in addition to the ammonia gas, preferably an inert gas, such as nitrogen gas and/or hydrogen gas or a mixture thereof, for example, having a composition of 95 wt % of nitrogen gas and 5 wt % of hydrogen gas, is introduced into the annealing furnace in order to avoid potential oxidation processes.

The total amounts of uncombined nitrogen introduced by nitriding the packaging steel in two stages are in a range of 100 to 500 ppm, preferably above 150 ppm, and most preferably in a range of 200 to 350 ppm. In the first stage of nitriding the molten steel, a maximum of 160 ppm of nitrogen is introduced into molten steel. Maintaining an upper limit of approximately 160 ppm of uncombined nitrogen in the molten steel ensures that the slab produced from the molten steel is free from defects, for example, in the form of pores and cracks, which may be generated as a result of oxidation by atmospheric oxygen. In addition, by ensuring that the nitrogen content does not exceed 160 ppm, the hot strip produced from the slab continues to be cold-rollable.

The amount of uncombined nitrogen that can be additionally introduced in the second stage of nitriding the flat steel product is preferably in a range of 180 to 350 ppm. Thus, using the two-stage nitriding process, a total amount of up to 500 ppm of uncombined nitrogen can be introduced into the packaging steel produced according to the present invention. As a result, it is possible to achieve ultimate tensile strengths of more than 650 MPa and up to 1000 MPa, which leads to the conclusion that there is a linear relationship between the content of uncombined nitrogen and the ultimate tensile strength and that, to achieve ultimate tensile strengths of approximately 650 MPa, a content of uncombined nitrogen of approximately 200 ppm is required.

To subject the cold-rolled flat steel product to recrystallization annealing, the product is preferably heated to temperatures of more than 600° C. and most preferably to temperatures of more than 620° C. in the annealing furnace. By means of recrystallization annealing, the formability of the cold-rolled flat steel product is restored. It has been found that the temperature used for heating the flat steel product is preferably in a range of 620° C. to 660° C. and most preferably approximately 640° C.

When nitriding the flat steel product in the second stage which takes place in the annealing furnace, it is preferable to use a plurality of spray nozzles, by means of which a nitrogen-containing gas, such as ammonia gas, can be uniformly applied to the surface of the flat steel product. During the production of a steel strip which is passed through the annealing furnace at a strip speed of a minimum of 200 m/min, the plurality of spray nozzles is preferably disposed equidistantly relative to one another, for example, at right angles to the strip conveyance direction. Using this configuration, it is possible to homogeneously nitride the flat steel product across the entire surface.

Measuring the concentration of the nitrogen-containing gas fed into the annealing furnace ensures that a consistent nitrogen atmosphere is maintained in the annealing furnace throughout the time in which the steel strip passes through the annealing furnace. This ensures that the steel strip is homogeneously nitrided throughout its length.

Comparative experiments were able to establish that nitriding the packaging steel produced according to the present invention not only increases its strength but, because of the higher content of uncombined nitrogen in the steel, also improves its formability. This can be observed especially in packaging steels produced according to the present invention that are coated with lacquer. After a heat treatment of prior-art lacquer-coated packaging steels which is necessary for baking the lacquer, a sharp reduction in the elongation to fracture of the flat steel product is observed at higher strengths. This phenomenon is not observed in nitrided flat steel products produced according to the present invention. Even at very high strengths of more than 650 MPa, no reduction in the elongation to fracture is observed after a heat treatment for baking the lacquer (lacquer aging). A possible explanation for this may be that the high content of uncombined nitrogen present as a result of the two-stage nitriding process and the highly homogeneous distribution of nitrogen first locks the dislocations present in the steel and that in the course of the deformation of the flat steel product, a large number of these dislocations that are locked by free nitrogen atoms are suddenly freed when an applied tensile stress is increased above a maximum value. This allows the many dislocations which, as a result of the deformation, are freed from being locked by the nitrogen atoms to be able to move in the steel, which improves the formability.

BRIEF DESCRIPTION OF THE DRAWINGS

This and other advantages of the packaging steel produced according to the present invention follow from the embodiment example described in greater detail below with reference to the accompanying drawings. The drawings show:

FIG. 1: a schematic representation of an annealing furnace in which the second stage of the method according to the present invention is carried out.

DETAILED DESCRIPTION OF THE INVENTION

In an embodiment example of the method according to the present invention, first a nitrided molten steel is produced in a converter and/or in a subsequent ladle treatment [station], said molten steel having a content of free, uncombined (i.e., dissolved in the steel) nitrogen of up to 160 ppm. The alloy composition of the steel preferably meets the limit values specified by the standards for packaging steel (such as defined, e.g., in ASTM Standard A623-11 "Standard Specification for Tin Mill Products" or in "European Standard EN 10202"), with the exception of the upper limit value for the nitrogen content (which in Standard EN 10202 is given as $N_{max}$=80 ppm and in AST [sic] Standard ASTM 623 as $N_{max}$=200 ppm) which, because of the nitriding process, can be exceeded in the method according to the present invention. The carbon fraction is preferably in a range of 10 to 1000 ppm and most preferably in a range of 100 to 900 ppm and, as a rule, in a range of 400 to 900 ppm.

To produce the molten steel, the converter is filled with scrap and pig iron, and a blast of oxygen gas and nitrogen gas is supplied to the molten steel, said oxygen gas ($O_2$) being blown from the top and the nitrogen gas ($N_2$) being blown through tuyeres from the bottom into the converter. As a result, the nitrogen content that obtains in the molten steel is 70 to 120 ppm, which leads to saturation. During the production of the molten steel, the composition and, in particular, the nitrogen content of the molten steel is measured. If the chemical composition is not within the required limits (e.g., if the fraction of phosphorus is too high), oxygen gas is blown in through an oxygen lance and argon gas (Ar) through the bottom tuyeres. Since only a very small amount of carbon (C) is still contained in the steel, no excess pressure builds up and the nitrogen of is drawn in, which can lead to additional nitriding.

If the amount of (dissolved) nitrogen desired in the molten steel (which, as a rule, is approximately 120 ppm) has not yet been reached by blowing in the nitrogen gas, lime nitrogen (calcium cyanamide, $CaCN_2$) can additionally be fed into the stream of steel exiting the converter while the converter is being emptied (tapped). The calcium cyanamide can be added for example, in the form of granules (5-20 mm).

Subsequently, the ladle is transferred to the first argon rinsing station where rinsing with argon takes place for approximately 3 minutes, using a refractory lance that is immersed in the molten steel. Following a control analysis, if necessary, rinsing in a second argon rinsing station takes place a second time for approximately 3 minutes. The ladle then goes to a third argon rinsing station. This is the last stage prior to casting. If the nitrogen content is not within the preset target range, manganese nitride (MnN), for example, in the form of a wire of MnN [sic] in a steel sheath, can be added. The amount of possibly lacking nitrogen is converted into a required amount of MnN (for example, into a required length of the MnN wire) which is added to the molten steel. The MnN is added until the preset target content of nitrogen or an upper Mn limit of the steel is obtained.

Finally, the molten steel is emptied into a tundish in order to cast a slab from the molten steel. Because of leaks and the diffusion of atmospheric nitrogen into the molten steel, the nitrogen content can increase by approximately 10 ppm. An upper limit of the amount of dissolved nitrogen in the cast steel slab of approximately 160 ppm should not be exceeded since at a nitrogen content higher than the upper limit mentioned, it is possible for defects, such as cracks or pores, to form on the slab, which lead to an undesirable oxidation.

The slab cast from the molten steel is subsequently hot-rolled and cooled to room temperature. The hot strip produced has thicknesses in a range of 1 to 4 mm and, if desired, is wound into a coil. To produce a packaging steel in the form of a flat steel product in the usual thin and ultra-thin sheet metal thicknesses, the hot strip must be cold-rolled, during the course of which the thickness is reduced by 50% up to more than 90%. Thin sheet metal is defined as sheet metal having a thickness of less than 3 mm, and an ultra-thin sheet metal has a thickness of less than 0.5 mm. Cold-rolling is accomplished by unwinding the potentially coiled hot strip from the coil, by pickling it and by feeding it into a cold rolling mill, for example, a cold rolling line.

To restore the crystal structure of the steel which had been destroyed during cold rolling, the cold-rolled steel strip must be subjected to recrystallization annealing. This is accomplished by passing the cold-rolled steel strip through a continuous annealing furnace in which the steel strip is heated to temperatures above the recrystallization point of the steel and, in particular, to temperatures above 600° C. During the course of the method carried out according to the present invention, the steel strip is further nitrided in a second stage while being subjected to recrystallization annealing. This stage is carried out in the annealing furnace by feeding a nitrogen-containing gas, preferably ammonia ($NH_3$), into the annealing furnace.

FIG. 1 is a diagrammatic representation of a continuous annealing furnace in which the recrystallization and nitriding during the second stage take place. This furnace is configured to have a number of different zones which, in the throughput direction (strip conveyance direction V, in FIG.

1 from right to left) of the steel strip passing though the continuous annealing furnace, are disposed one behind another. In a heating zone 1 disposed on the input side of the continuous annealing furnace, the steel strip S is heated to temperatures in the range of 600° C. to 750° C. The temperature especially favorable for the second nitriding stage was found to be in a range of 620° C. to 700° C., and the temperature especially preferred was found to be in a range of 620° C. to 660° C. The best results were obtained at temperatures of approximately 640° C. These temperatures are above the recrystallization temperature of the steel, which is the reason that the steel strip S is subjected to recrystallization annealing in heating zone 1.

The heating zone 1 is adjoined by a temperature holding zone 2 in which the temperature of the steel strip S is maintained within the temperature range specified above. In the temperature holding zone 2, a plurality of cascades 3*a*, 3*b*, 3*c* of spray nozzles are disposed one behind another in the strip conveyance direction. Each cascade 3*a*, 3*b*, 3*c* comprises a plurality of nozzles 3, which, in the strip conveying direction, are disposed at a distance from and at right angles relative to one another. The nozzles 3 are connected to a gas feeding line, via which they receive a nitrogen-containing gas. The gas especially favorable for the second nitriding stage was found to be ammonia gas. By means of the nozzles 3 of the cascades, this gas is applied to the surfaces of the steel strip S passing through the furnace where it penetrates into the area near the surface of the steel strip and uniformly diffuses into the depth of the steel strip. Thus, the nitrogen is uniformly and homogeneously distributed throughout the thickness of the steel strip, and its concentration distribution for steel sheets having a thickness of less than 0.4 mm varies from the mean value by at most ±10 ppm and, as a rule, by only ±5 ppm throughout the sheet thickness.

The configuration of the preferably used nozzles 3 of the cascades is described in the German Patent Application DE 102014106135 of Apr. 30, 2014, with the content disclosed therein hereby being incorporated into the subject matter of the present application. In the application referred to, a nozzle assembly for the treatment of a flat steel product is described, said nozzle assembly comprising an outer tube and an inner tube disposed therein having a primary opening for feeding a gas flowing through the nozzle assembly into the outer tube and said outer tube having a secondary opening through which the gas can exit. The primary opening of the inner tube and the secondary opening of the outer tube are disposed so as to be offset relative to each other. Because of this arrangement, a highly homogeneous gas flow onto the surface of the flat steel product is made possible. Using this type of nozzle assembly in the method according to the present invention, the surface of the steel strip can be homogeneously exposed to the nitrogen-containing gas (ammonia) in the temperature holding zone 2 of the continuous annealing furnace, which makes it possible for nitrogen to be homogeneously diffused throughout the surface of the steel strip, in particular throughout its width, and thus for a homogeneous nitrogen-enriched and hardened surface layer to be formed.

The method of direct exposure of the steel strip (exposure to gas) to a nitrogen-containing gas by means of nozzles has two major advantages. First, only a low nitrogen concentration ($NH_3$ concentration) in the inert gas is needed, which leads to a low consumption of nitrogen-containing gas (for example, $NH_3$ consumption). Secondly, because of the very short exposure time, the formation of a nitride layer is avoided. Following the exposure to a nitrogen-containing gas (for example, $NH_3$ treatment), the steel continues to be further annealed (preferably for more than 5 seconds) at unchanged temperatures before it is cooled. This leads to a homogenous nitrogen distribution throughout the cross section of the steel strip and thus to improved forming properties. More particularly, it makes it possible to avoid a reduction in the elongation to fracture due to lacquer aging.

To also ensure the most homogeneous formation of a nitrogen-enriched surface coating throughout the length of the steel strip S, a nitrogen-rich atmosphere with the most consistent possible nitrogen equilibrium concentration must be maintained while the steel strip S passes through the temperature holding zone 2 of the continuous annealing furnace. To ensure that this is the case, the nitrogen concentration is measured in the region of the cascades 3*a*, 3*b*, 3*c* comprising the nozzles 3. If ammonia is used as the nitrogen-containing gas, the ammonia concentration formed in the temperature holding zone 2 as a result of the exposure to ammonia is measured. To this end, a concentration sensor disposed outside the continuous annealing furnace is provided, which sensor may, for example, be a laser spectroscopy sensor. To measure the ammonia concentration and, therefrom, the nitrogen concentration of the gas atmosphere in the temperature holding zone 2, a gas sample drawn from the temperature holding zone 2 is transferred to said sensor. The gas sample is drawn, for example, at the point designated by the reference character 4 in FIG. 1. The concentration of nitrogen in the gas atmosphere of the temperature holding zone 2 measured by the concentration sensor is fed to a control unit which uses it to hold the amount of the nitrogen-containing gas (ammonia) sprayed through the nozzles 3 into the temperature holding zone 2 constant at a preset target value.

When ammonia is used as the nitrogen-containing gas, target values for the equilibrium concentration of ammonia in a range of 0.05 to 1.5%, and preferably lower than 1%, especially lower than 0.2%, have been proven to be especially useful. Preferably, the equilibrium concentration of ammonia is in a range of 0.1% to 1.0% and most preferably in a range of 0.1% to 0.2%.

To avoid oxidation processes on the surface of the steel strip S, it is recommended that in the temperature holding zone 2, an inert gas, in addition to the nitrogen-containing gas (ammonia), be also fed into the annealing furnace. This gas may be, for example, nitrogen gas or/or [sic; and/or] hydrogen gas. Preferably, a mixture of approximately 95% of nitrogen gas and approximately 5% of hydrogen gas is used.

In the strip conveying direction V, the temperature holding zone 2 is adjoined by a plurality of cooling zones 5, 6, wherein a more rapid cooling of the steel strip S takes place in a first cooling zone 5 and a slower cooling in a downstream second cooling zone 6.

After having undergone cooling in the cooling zones 5 and 6, the steel strip S exits the continuous annealing furnace and is dry skin pass rolled (temper rolled) to ensure that the strip has the forming properties required for the production of packaging materials. The skin pass degree varies between 0.4% and 2% depending on the intended use of the packaging steel. If necessary, the steel strip can also be wet skin pass rolled in order to further reduce the thickness by up to 43% (double reduced steel strip, "double reduced," DR). Subsequently, the steel strip S, if desired, is transferred to a coating station in which the surface of the steel strip is, for example, electrolytically coated with a tin coating or a chromium/chromium dioxide coating (ECCS) or a lacquer coating in order to increase the corrosion resistance. It has been found that compared to the prior-art flat steel products, the packaging steels produced by means of the method according to the present invention also have improved anticorrosive properties.

Using the method according to the present invention, it is possible to produce nitrided steel strips which are distinguished by an extremely high strength of more than 600 MPa, while at the same time having an excellent elongation to fracture higher than 5% and good forming properties. The increased strength resulting from the two-stage nitriding process and the elongation to fracture are very homogeneously distributed throughout the cross section of the cold-rolled steel strip, both in and at right angles relative to the rolling direction. The reason for this is that uncombined nitrogen has been very homogeneously introduced into the steel, especially in the second nitriding stage. In addition, chemical composition analyses performed on flat steel products produced according to the present invention have also shown that at least in ultra-fine steel sheets, the nitrogen concentration introduced by nitriding varies from the mean concentration only within a narrow range of at most ±10 ppm and, as a rule, only by ±5 ppm.

Recrystallization annealing and the second nitriding stage can also be carried out in a bell-type annealing furnace instead of in a continuous annealing furnace. When using this furnace, the cold-rolled coiled steel strip S is fed into a bell-type annealing furnace where it is annealed under an inert gas atmosphere at the annealing temperatures required for recrystallization annealing of more than 520° C. In order to be able to carry out the second nitriding stage simultaneously with recrystallization annealing in the bell-type annealing furnace, bell-type annealing employs the "open coil" method. In this method, spacers are placed between the layers of a coiled steel strip in order to keep the surface of the steel strip accessible for diffusing nitrogen into it.

In the tables below, embodiment examples of flat steel products produced according to the present invention are listed in a number of variants (each referred to as "Variant") and for different applications for the production of packaging materials and/or parts thereof (pull-tab lid for a tin can and deep-drawn twist-off caps) and compared with flat steel products produced in the prior art (without two-stage nitriding, each referred to as "Standard") with an identical or similar steel composition (alloy components).

TABLE 1

Embodiment example of a packaging steel for use in the production of full-top pull-tabs lids (Standard grade with C = 600-900 ppm, N = 80-140 ppm)

| | | | Standard Single-stage nitriding of the molten steel | Variant 1 Two-stage nitriding acc. to the present invention |
|---|---|---|---|---|
| Chemical analysis | C | [ppm] | 740 | 750 |
| | N | [ppm] | 122 | 187 |
| | Mn | [ppm] | 3100 | 3100 |
| | Al | [ppm] | 150 | 150 |
| | Si | [ppm] | 90 | 110 |
| | Cr | [ppm] | 290 | 270 |
| | Ni | [ppm] | 130 | 120 |
| | Cu | [ppm] | 130 | 70 |
| | P | [ppm] | 140 | 150 |
| | S | [ppm] | 50 | 40 |
| Hot strip | Thickness | [mm] | 2.0 | 2.0 |
| | $T_{finish\ rolling}$ | [° C.] | 861 | 854 |
| | $T_{coiling}$ | [° C.] | 571 | 570 |
| | $T_{annealing}$ | [° C.] | 670 | 640 |
| Cold Strip | Skin pass degree | [%] | 8 | 11 |
| | Final thickness | [mm] | 0.160 | 0.160 |
| Performance characteristic | Upper yield stress ($R_{eh}$) (200° C., 20 min) | [MPa] | 560 | 640 |
| | Ultimate tensile strength (200° C., 20 min) | [MPa] | 540 | 644 |
| | Ear height (β = 1.8. Cup = 33 mm | [mm] | — | — |
| | Elongation to fracture | [%] | 4.2 | 8.5 |

TABLE 2

Embodiment example a packaging steel for use in the production of deep-drawn twist-off caps (Standard grade with C = 10-40 ppm, N < 40 ppm)

| | | | Standard 1 | Standard 2 | Variant 1 Two-stage nitriding acc. to the resent invention | Variant 2 Two-stage nitriding acc. to the resent invention | Variant 3 Two-stage nitriding acc. to the resent invention |
|---|---|---|---|---|---|---|---|
| Chemical analysis | C | [ppm] | 23 | 25 | 28 | 20 | 17 |
| | N | [ppm] | 15 | 30 | 110 | 170 | 180 |
| | Mn | [ppm] | 2100 | 2100 | 2200 | 2300 | 2300 |
| | Al | [ppm] | 20 | 20 | 20 | 180 | 10 |
| | Si | [ppm] | 220 | 200 | 190 | 100 | 230 |
| | Cr | [ppm] | 250 | 210 | 200 | 180 | 210 |
| | Ni | [ppm] | 130 | 110 | 110 | 150 | 120 |
| | Cu | [ppm] | 80 | 60 | 70 | 60 | 70 |
| | P | [ppm] | 100 | 90 | 80 | 90 | 70 |
| | S | [ppm] | 70 | 70 | 60 | 70 | 80 |
| Hot strip | Thickness | [mm] | 2.5 | 2.5 | 2.5 | 2.5 | 2.5 |
| | $T_{finish\ rolling}$ | [° C.] | 870 | 877 | 880 | 871 | 862 |
| | $T_{Coiling}$ | [° C.] | 631 | 621 | 620 | 601 | 618 |
| Cold strip | $T_{annealing}$ | [° C.] | 690 | 690 | 690 | 690 | 690 |
| | Skin pass degree | [%] | 40 | 40 | 40 | 40 | 32 |
| | Final thickness | [mm] | 0.140 | 0.154 | 0.140 | 0.140 | 0.140 |
| Performance characteristics | Upper yield stress ($R_{eh}$) (200° C., 20 min) | [MPa] | 633 | 598 | 680 | 685 | 690 |
| | Ultimate tensile strength (200° C., 20 min) | [MPa] | 633 | 599 | 680 | 685 | 690 |
| | Ear height (β = 1.8. Cup = 33 mm) | [mm] | 0.70 | 0.75 | 0.65 | 0.71 | 0.68 |
| | Elongation to fracture | [%] | 0.35 | 1.59 | 1.01 | 0.85 | 1.89 |

The invention claimed is:

1. A method for producing a nitrided packaging steel having a carbon content of 10 to 1000 ppm by weight and a quantity of uncombined nitrogen dissolved therein of at least 150 ppm by weight, the method comprising:

nitriding a molten steel to a nitrogen content of a maximum 160 ppm by weight by feeding nitrogen into the molten steel in a form of a nitrogen-containing gas or a nitrogen-containing solid to form a nitrided molten steel;

casting a slab from the nitrided molten steel;

hot-rolling the slab to form to a hot-rolled strip;

cold-rolling the hot-rolled strip to form a flat steel product; and recrystallization annealing and nitriding the flat steel product in a continuous annealing furnace, the recrystallization annealing and nitriding including;

passing the flat steel product through the continuous annealing furnace; and introducing a nitrogen-containing gas into the continuous annealing furnace, directing the nitrogen-containing gas onto the flat steel product while passing the flat steel product through the continuous annealing furnace at a strip speed of at least 200 m/min, and increasing a quantity of uncombined nitrogen in the flat steel product to at least 150 ppm by weight, thereby producing the nitrided packaging steel, the nitrided packaging steel produced having a tensile strength of more than 600 MPa and an elongation at fracture of at least 5%.

2. The method according to claim 1, wherein nitriding a molten steel includes feeding nitrogen gas ($N_2$), calcium cyanamide ($CaCN_2$), manganese nitride (MnN), or combinations thereof into the molten steel.

3. The method according to claim 1, wherein introducing a nitrogen-containing gas into the continuous annealing furnace includes introducing ammonia gas ($NH_3$) into the continuous annealing furnace.

4. The method according to claim 3, wherein introducing ammonia gas ($NH_3$) includes directing the ammonia gas onto the flat steel product through one spray nozzle or through a plurality of spray nozzles.

5. The method according to claim 3, wherein introducing the ammonia gas includes establishing an ammonia equilibrium with an ammonia-equilibrium concentration in a range of 0.05 to 1.5% in the continuous annealing furnace.

6. The method according to claim 5, further comprising measuring a value of the ammonia-equilibrium concentration using an ammonia sensor.

7. The method according to claim 6, further comprising using the value of the ammonia-equilibrium concentration measured to control a quantity of ammonia gas fed per unit of time into the continuous annealing furnace.

8. The method according to claim 3, further comprising, in addition to the ammonia gas, introducing an inert gas into the continuous annealing furnace.

9. The method according to claim 1, wherein recrystallization annealing includes heating the flat steel product to a temperature of more than 600° C.

10. The method according to claim 1, wherein the nitrided packaging steel produced has a carbon content in a range of 100 to 1000 ppm by weight.

11. The method according to claim 1, wherein the nitrided packaging steel produced has a thickness of less than 0.5 mm.

12. The method according to claim 11, wherein, after nitriding the flat steel product in the continuous annealing furnace, the uncombined nitrogen has a mean concentration value of 150 ppm or more by weight and a concentration distribution of the uncombined nitrogen varies from the mean concentration value by less than ±10 ppm by weight throughout the thickness of the nitrided packaging steel.

13. A method for producing a nitrided packaging steel having a carbon content of 10 to 1000 ppm by weight and a quantity of uncombined nitrogen dissolved therein of 150 ppm or more by weight, the method comprising:

forming a nitrided molten steel having a carbon content of 10 to 1000 ppm by weight by nitriding a molten steel to a nitrogen content of a maximum 160 ppm by weight by feeding nitrogen into the molten steel in a form of a nitrogen-containing gas or a nitrogen-containing solid;

casting a slab from the nitrided molten steel;

hot-rolling the slab to form to a hot-rolled strip;

cold-rolling the hot-rolled strip to form a flat steel product having a thickness of less than 0.5 mm;

recrystallization annealing and nitriding the flat steel product in a continuous annealing furnace by passing the flat steel product through the continuous annealing furnace and heating the flat steel product to a temperature in a range of 620° C. to 660° C.;

feeding ammonia gas ($NH_3$) into the continuous annealing furnace to produce a nitrogen gas containing atmosphere in the continuous annealing furnace having an ammonia equilibrium concentration in a range of 0.05% to1.5%; and directing the ammonia gas onto surfaces of the flat steel product using a spray nozzle or a plurality of spray nozzles to increase the quantity of uncombined nitrogen in the flat steel product to 150 ppm or more by weight, thereby producing the nitrided packaging steel, the nitrided packaging steel produced having a homogenous concentration distribution of the quantity of uncombined nitrogen throughout thickness thereof and lacking a nitride layer on surfaces thereof.

14. The method according to claim 13, wherein the nitrided packaging steel produced has a tensile strength of more than 600 MPa and an elongation at fracture of at least 5%.

15. The method according to claim 13, wherein nitriding a molten steel includes feeding nitrogen gas ($N_2$), calcium cyanamide ($CaCN_2$), manganese nitride (MnN), or combinations thereof into the molten steel.

16. The method according to claim 13, further comprising measuring a value of the ammonia-equilibrium concentration using an ammonia sensor.

17. The method according to claim 16, further comprising using the value of the ammonia-equilibrium concentration measured to control a quantity of ammonia gas fed per unit of time into the continuous annealing furnace.

18. The method according to claim 13, further comprising, in addition to the ammonia gas, introducing an inert gas into the continuous annealing furnace.

19. A method for producing a nitrided packaging steel having a carbon content of 10 to 1000 ppm by weight and a quantity of uncombined nitrogen dissolved therein in a range of 150 ppm to 500 ppm by weight, the method comprising:

a first nitriding step including forming a nitrided molten steel having a carbon content of 10 to 1000 ppm by weight by nitriding a molten steel to a nitrogen content of a maximum 160 ppm by weight by feeding nitrogen into the molten steel in a form of a nitrogen-containing gas or a nitrogen-containing solid;

casting a slab from the nitrided molten steel;

hot-rolling the slab to form to a hot-rolled strip;

cold-rolling the hot-rolled strip to form a flat steel product;

a second nitriding step including recrystallization annealing and nitriding the flat steel product in a continuous annealing furnace by passing the flat steel product through the continuous annealing furnace and heating the flat steel product to a temperature in a range of 620° C. to 660° C.;

feeding ammonia gas ($NH_3$) into the continuous annealing furnace to produce a nitrogen gas containing atmosphere in the continuous annealing furnace having an ammonia equilibrium concentration in a range of 0.05% to 1.5%;

directing the ammonia gas onto surfaces of the flat steel product using a spray nozzle or a plurality of spray nozzles, thereby increasing the quantity of uncombined nitrogen in the flat steel product achieved in the first nitriding step to a range of 150 to 350 ppm by weight without formation of a nitride layer on the surfaces of the flat steel product;

continuing annealing of the flat steel product for at least 5 seconds at the temperature in the range of 620° C. to 660° C.; and cooling the annealed flat steel product, thereby producing the nitrided packaging steel, the nitrided packaging steel produced having a tensile strength of more than 600 MPa and an elongation at fracture of at least 5%.

20. The method according to claim 19, wherein a total amount of uncombined nitrogen introduced in the first and second nitriding steps is in a range of 200 ppm to 350 ppm by weight.

* * * * *